US007650099B2

(12) United States Patent
Yano et al.

(10) Patent No.: US 7,650,099 B2
(45) Date of Patent: Jan. 19, 2010

(54) IMAGE FORMING APPARATUS HAVING TENSION-PROVIDING MECHANISM FOR BELT

(75) Inventors: Takashi Yano, Shizuoka-ken (JP); Yasuhiko Fuse, Numazu (JP); Hiroshi Kato, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 215 days.

(21) Appl. No.: 11/689,322

(22) Filed: Mar. 21, 2007

(65) Prior Publication Data

US 2007/0223956 A1 Sep. 27, 2007

(30) Foreign Application Priority Data

Mar. 23, 2006 (JP) ..... 2006-080876
Mar. 13, 2007 (JP) ..... 2007-062796

(51) Int. Cl.
*G03G 15/00* (2006.01)

(52) U.S. Cl. ..... 399/165

(58) Field of Classification Search ..... 399/107, 399/121, 162, 165
See application file for complete search history.

(56) References Cited

U.S. PATENT DOCUMENTS 4,563,077 A * 1/1986 Komada ..... 399/165
5,845,144 A 12/1998 Tateyama et al. ..... 395/800.01
6,711,367 B2 3/2004 Saito et al.

FOREIGN PATENT DOCUMENTS

JP 05-232752 A 9/1993
JP 05-281854 A 10/1993
JP 2000-162890 A 6/2000
JP 2003-076155 A 3/2003
JP 2005-049678 A 2/2005
JP 2006018021 A * 1/2006

* cited by examiner

*Primary Examiner*—David M Gray
*Assistant Examiner*—Andrew V Do
(74) *Attorney, Agent, or Firm*—Fitzpatrick, Cella, Harper & Scinto

(57) ABSTRACT

To enable not only releasing pressurization by a pressurization mechanism for pressurizing a belt thereby preventing a deformation therein but also easily and securely releasing the pressurization mechanism held in the pressure release state, thereby facilitating the installation operation of an apparatus. A pressurization mechanism for pressurizing a belt is in a released state prior to the use of the main body of the apparatus. Prior to the initial use of the main body, the pressurization of the pressurizing mechanism for the belt is exerted in linkage with a user operation of placing a recording material in a feed tray.

5 Claims, 11 Drawing Sheets

IMAGE FORMING APPARATUS HAVING TENSION-PROVIDING MECHANISM FOR BELT

BACKGROUND OF THE INVENTION

1. Field of the Invention

The present invention relates to an image forming apparatus including a belt and a mechanism for releasing a tension provided to the belt.

2. Description of the Related Art

An image forming apparatus including a belt, such as a transfer belt, is provided, depending on the construction of the apparatus, with a mechanism of providing a pressure by a pressurization mechanism. The belt is often formed by an elastic material such as rubber or plastics. The pressurized member of such elastic material, when let to stand over a time, may require a time for recovery from a deformed state or may remain in the deformed state, depending on pressure and atmospheric conditions such as temperature and humidity. Such deformation may cause problems such as an image defect or a conveying failure.

In general, the product such as an image forming apparatus is so designed as not to easily cause such problems under certified conditions of operation, but during transportation or storage in the course of circulation of the product, it may be let to stand over a time under an environment exceeding the certified conditions of operation. In order to guarantee the quality of the product even in such situation, there is known a method of releasing the pressurization by the pressurization mechanism only during the delivery from the forwarding of the product to the installation thereof.

Following is known as background technology. In a commonly employed constitution, an exclusive pressure releasing member is mounted, at the forwarding of the product, to release the pressurization by the pressurization mechanism, and, at the installation thereof, the pressure releasing member is removed by the user to restore the pressurization by the pressurization mechanism. More specifically, FIGS. 10A and 10B illustrate a conventional construction for releasing the pressurization by the pressurization mechanism for an intermediate transfer belt. A tension roller 91 is slidably supported, at both ends thereof, by elongated holes 96*a*, 97*a* formed in unit frames 96, 97, and provides the intermediate transfer belt 90 with a tension, by the functions of tension levers 92, 93 and tension springs 94, 95. At the forwarding of the product, tension releasing pieces 99 are inserted into the elongated holes 96*a*, 97*a* formed of the unit frames 96, 97, thereby forcedly retract the tension roller 91 and releasing the tension of the intermediate transfer belt 90. Then, at the installation of the product, the user extracts the tension releasing pieces 99 according to the installation procedure, whereby the intermediate transfer belt 90 is given a tension by the tension roller 91 and is pressurized again.

However, such constitution requires that the user executes the extracting operation of the tension releasing pieces 99, and there is also a concern for an accident caused by a forgotten extracting operation.

SUMMARY OF THE INVENTION

An object of the present invention is to enable, by another operation at the setting of a main body of an apparatus, providing a belt with a tension, thereby alleviating the burden of setting operation for the main body of the apparatus, and to prevent a forgotten initial setting of the belt.

Another object of the present invention is to provide an image forming apparatus including: a unit that can be positioned at a first position and a second position with respect to a main body of the apparatus; a belt, a support member in contact with an internal surface of said belt, a tension member which moves said support member which gives said belt a tension, and a restriction member for restricting a movement of said support member, wherein said support member is released from the restriction of said restriction member when said unit is moved from the first position to the second position, and said support member is maintained on release from the restriction of said restriction member even if said unit is moved from the second position to the first position.

Still another object of the present invention is to provide an image forming apparatus comprising a unit that can be positioned at a first position and a second position with respect to a main body of the apparatus; a belt; a support member in contact with an internal surface of said belt; a tension member which moves said support member which gives said belt a tension; and a restriction member for restricting a movement of said support member; wherein an operation which is moving said unit from the first position to the second position and then returning said unit to the first position causes said support member to be released from the restriction of said restriction member, and an image is able to be formed after said operation is done once.

Still another object of the present invention is to provide an image forming apparatus comprising a sheet feed unit extractable from a main body of the apparatus, a belt, a tension member for providing said belt with a tension, and a tension-providing mechanism which, by an operation which is extracting said sheet feed unit from the main body of the apparatus and then storing it into the main body of the apparatus, causes said tension member to provide said belt with a tension.

Further features of the present invention will become apparent from the following description of exemplary embodiments, with reference to the accompanying drawings.

DESCRIPTION OF THE EMBODIMENTS

In the following, embodiments of the present invention will be described exemplarily described with reference to the accompanying drawings. However, a dimension, a material, a shape, a relative position and the like of components, in the following exemplary embodiments, may be suitably changed according to the structure of the apparatus and various conditions to which the present invention is to be applied and should not be construed as to limit the scope of the invention thereto, unless specified otherwise.

Exemplary Embodiment 1

Figure 1:
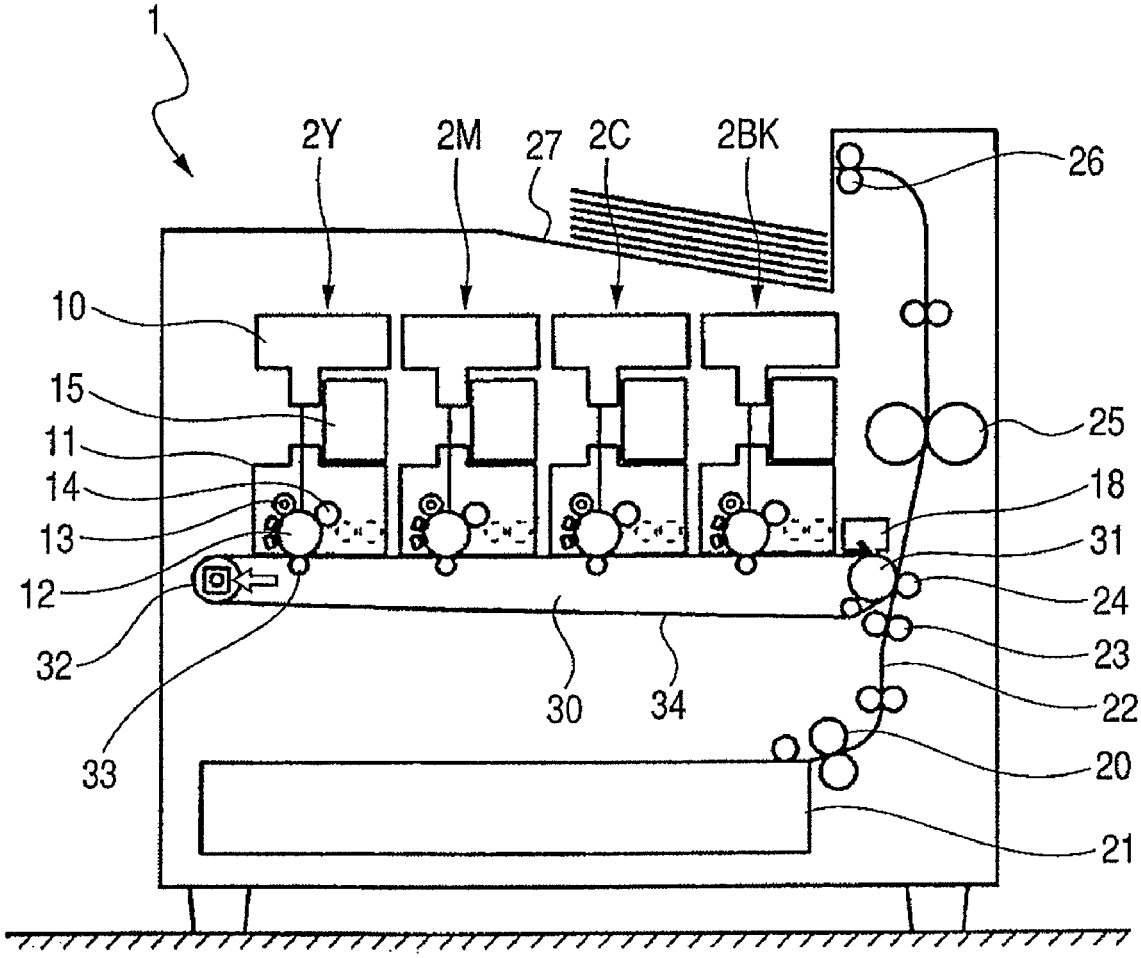
FIG. 1 is a schematic cross-sectional view illustrating an image forming apparatus in an exemplary embodiment 1 of the present invention.

An exemplary embodiment 1 of the present invention will be described with reference to FIGS. 1 to 5D. FIG. 1 is a schematic cross-sectional view of a printer, embodying the present invention. In a main body 1 of the printer, image forming units 2Y, 2M, 2C and 2Bk for forming primary images of four colors, respectively yellow (Y), magenta (M), cyan (C) and black (Bk), are provided in an upper part of the main body 1. The image forming units 2Y, 2M, 2C and 2Bk are different in the colors of the respectively formed toner images but are same in the basic functions, so that, in the following, the functions will be described on the image forming unit 2Y.

Print data transmitted from an external equipment such as a personal computer is received by a controller which controls the main body 1 of the printer, and is output as image writing data to a laser scanner 10. The laser scanner 10 emits a laser beam onto a photosensitive drum 12, thereby forming a latent image corresponding to the image writing data.

The image forming unit includes a toner cartridge 15 for toner supply, and a process cartridge 11 for forming a primary image. Each process cartridge 11 includes a photosensitive drum 12, and a charging device 13, a developing device 14 and a cleaner (not illustrated), constituting process means acting on the photosensitive drum 12. The charging device 13 applies a uniform charging on the surface of the photosensitive drum 12. The developing device 14 develops the latent image formed by the laser scanner 10. The cleaner removes the toner remaining on the photosensitive drum 12, after the transfer of toner image onto an intermediate transfer belt 34. In a position opposed to the photosensitive drum 12, provided is a primary transfer roller 33 for transferring the toner image, developed on the surface of the photosensitive drum 12, onto the intermediate transfer belt 34.

The toner image (primary image) transferred onto the intermediate transfer belt 34 is transferred, at a secondary transfer roller 24, onto a sheet. The toner, which is not transferred at the secondary transfer roller 24 but remains on the intermediate transfer belt 34, is recovered by a cleaner 18.

A feeding unit 20 is positioned at a most upstream side in a sheet conveying path, and is provided in a lower part of the apparatus. A feed tray 21, serving as a sheet containing member, is provided extractably in a lower part of the main body of the printer. A sheet, contained in a stack in the feed tray 21, when fed by the feed unit 20, passes through a vertical conveying path 22 and is conveyed to the downstream side. In the vertical conveying path 22, provided are a pair of registration rollers 23 which execute a final skew correction for the sheet and a synchronization of the image writing in the image forming unit and the sheet conveyance.

At the downstream side of the image forming unit, provided are a pair of fixing rollers 25, for fixing the toner image on the sheet. At the downstream side of the fixing rollers 25, provided are discharge rollers 26 for discharging the sheet from the main body 1 of the printer. In an upper par of the main body 1 of the printer, a discharge tray 27 is provided for receiving the sheet discharged by the discharge rollers 26.

In the constitution schematically described above, the intermediate transfer belt 34, the paired fixing rollers 25, the feeding unit 20 and the paired registration rollers 23 in the conveying path are subjected to pressurizing forces by pressurization mechanisms. An exemplary embodiment of the present invention will be described, taking the pressurization mechanism for the intermediate transfer belt 34 as an example among these members.

Figure 2:
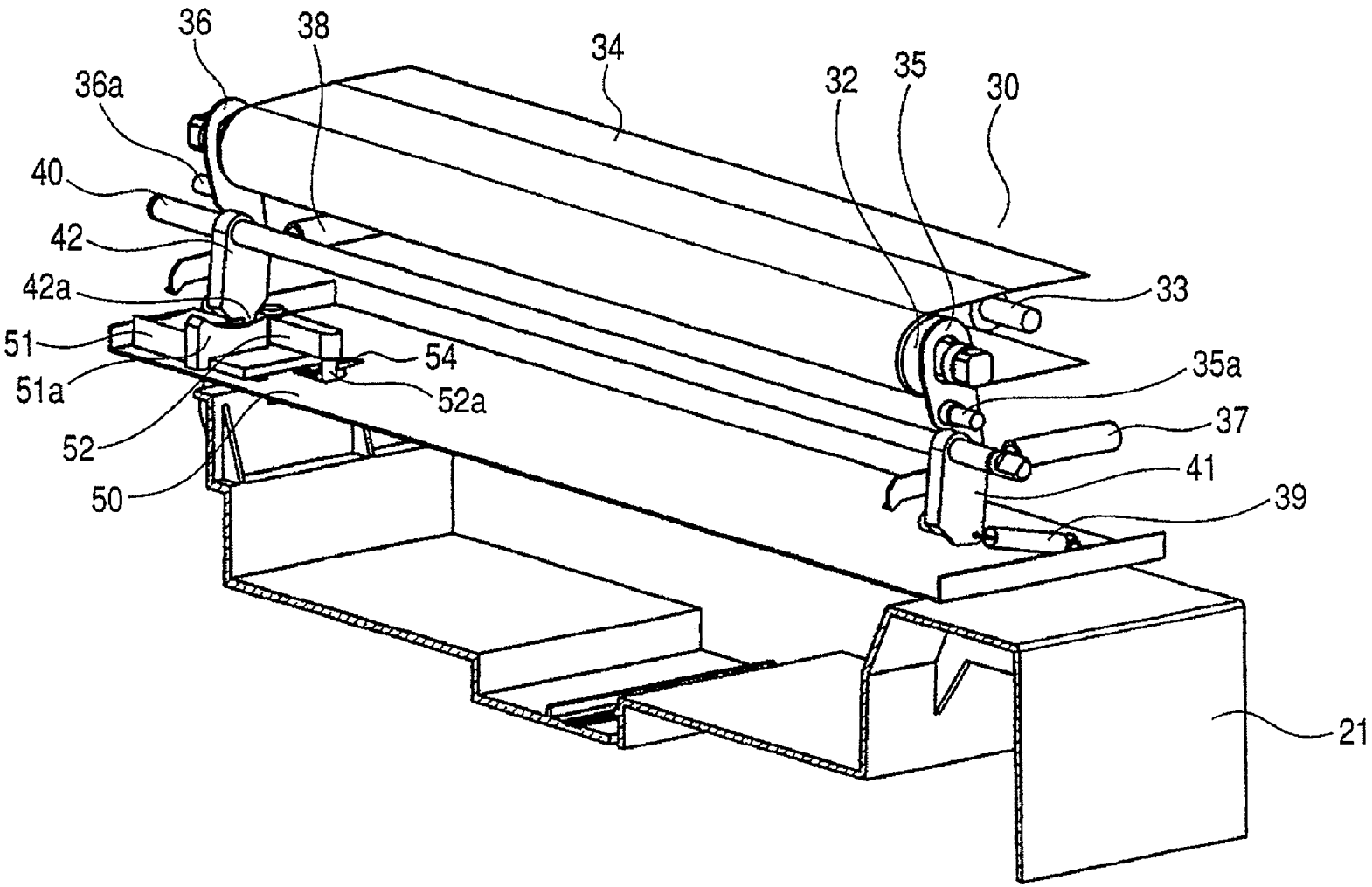
FIG. 2 is a schematic perspective view illustrating a structure for pressure release and hold release in a pressurization mechanism of the exemplary embodiment 1 of the present invention.

At first, the structure of the pressurization mechanism for the intermediate transfer belt 34 will be described with reference to FIGS. 2 and 1. The intermediate transfer belt 34 to be pressurized is supported by a drive roller 31 and a tension roller 32, which are support members provided in an ITB unit (intermediate transfer belt unit) 30. Tension springs 37, 38, constituting tension members, applies a tension to the tension roller 32, which in turn applies a tension to the intermediate transfer belt 34. The tension of the tension roller 32 depends on the materials constituting the intermediate transfer belt 34 and the drive roller 31 and on the construction of the apparatus, but is generally in a range about from 49 to 89 N (5 to 10 kgf) in total pressure. The tension roller 32 receives a pressurizing force from both ends thereof, by the function of tension levers 35, 36 which are so supported as to be capable of a rocking motion, about rocking shafts 35*a*, 36*a*, on the frame (not illustrated) of the ITB unit 30 and by the function of tension springs 37, 38.

Then explained is a structure of a link mechanism, for releasing the tension (pressurizing power) to the intermediate transfer belt 34. Between a front side plate and a rear side plate (not illustrated) of the image forming apparatus, a pressure release shaft 40 is supported rotatably. On the pressure release shaft 40, two pressure release arms 41, 42 are fixed, respectively at a front side and at a rear side of the apparatus. The pressure release arms 41, 42 are capable of engaging with the tension levers 35, 36 of the ITB unit 30, by the rotation of the pressure release shaft 40. When the pressure release arms 41, 42 engage with the tension levers 35, 36 to cause a rocking motion of the tension levers 35, 36, the tension roller 32 is displaced to release the tension in the intermediate transfer belt 34. The pressure release shaft 40 is urged in a rotational direction, opposite to the tension releasing direction, by a spring 39 linked with a pressure release arm 41 provided in a front side of the main body (front side of the apparatus), in order to stabilize an operation of releasing the position holding of the pressurization mechanism, as will be described later.

Then there will be described a constitution for holding the pressurization mechanism for the intermediate transfer belt 34 in a pressure release position in which the pressurization of the pressurization mechanism is released, and a constitution for releasing the position holding of the pressurization mechanism, held in the pressure release position.

Figure 3:
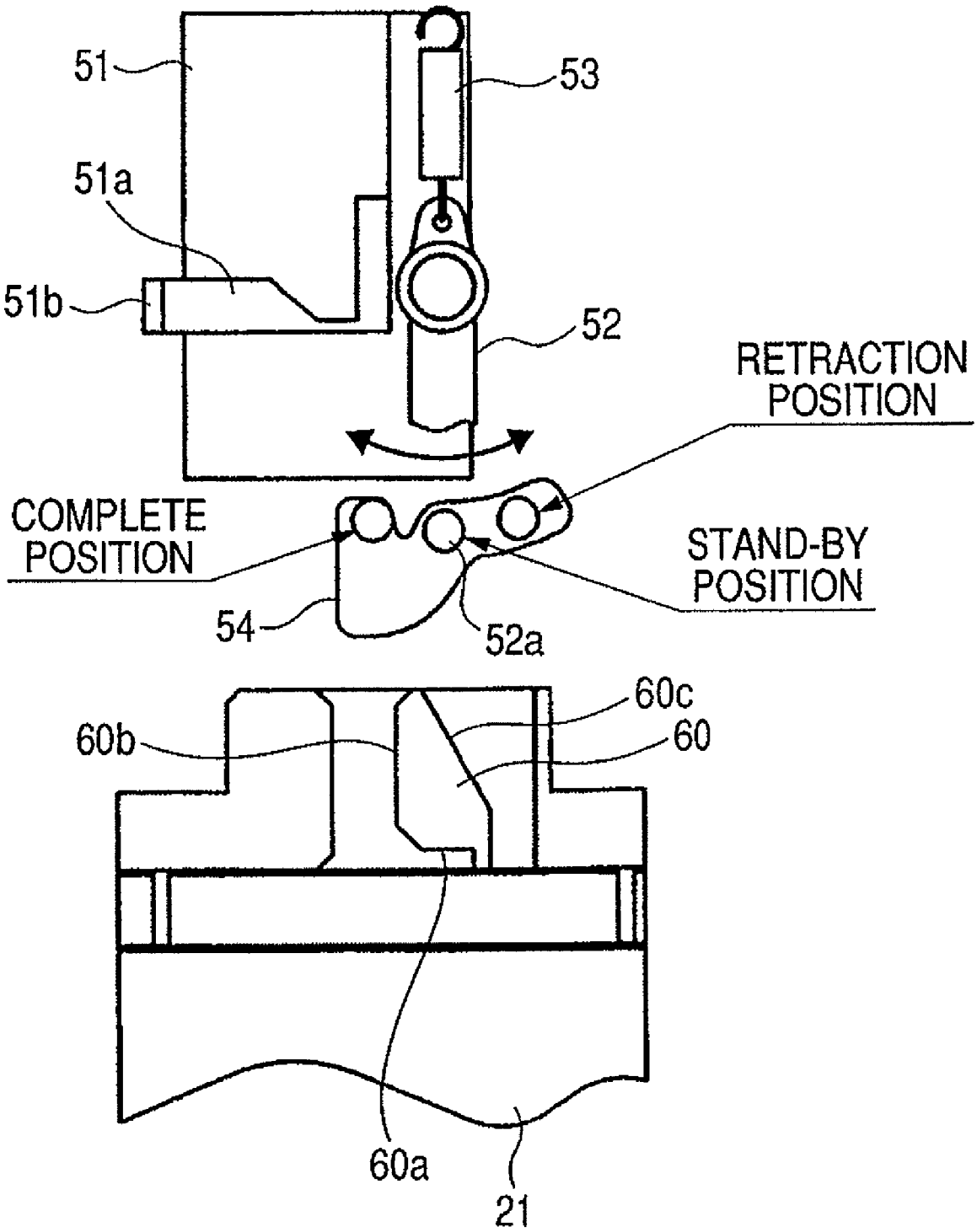
FIG. 3 is a partial view illustrating a structure for pressure release and hold release in a pressurization mechanism of the exemplary embodiment 1 of the present invention.

The pressure release arm 42, positioned in the rear side of the main body, has a projection portion 42*a* constituting an engaging portion of the pressurization mechanism. In a position opposed to the projection 42*a* of the pressure release arm 42, a hold block 51, serving as holding means, is slidably provided on a stay member 50 constituting the frame of the main body. The hold block 51 has a cam portion 51*a*, capable of engaging with the projection portion 42*a* of the pressure release arm 42. The hold block 51 also supports an action lever 52 so as to be capable of a rocking motion. The action lever 52 is given a biasing force by a spring 53 (FIG. 3). The hold block 51 is urged in one direction, in its movable direction, by receiving the force of the spring 53 across the action lever 52. A rocking end (free end) of the action lever 52 has a boss 52*a* as an action part of the holding means. As will be described in detail later in the description of functions, the hold block 51 is to hold the pressurization mechanism for the intermediate transfer belt 34 in a pressure release position (cf. FIG. 4C).

Under the ITB unit 30 in the apparatus, a feed tray 21 constructed as a movable member is provided across the stay member 50. The feed tray 21 is so constructed as to be extractable from the main body of the printer, toward the front side of the apparatus. A rear side wall of the feed tray 21 has a cam 60 as an engaging portion of the movable member, so as to engage with the boss 52*a* of the action lever 52 in the course of extraction of the feed tray 21. Also the stay member 50 has a guide hole 54 for guiding the boss 52*a* of the action lever 52, thus limiting the rocking position of the action lever 52 according to the operation stages. More specifically, as illustrated in FIG. 3, the guide hole 54 guides the boss 52*a* of the action lever 52 thereby limiting the rocking position of the action lever 52 in one of a stand-by position, a completion position and a retraction position. The action lever 52 is so urged, by means of the spring 53, as to be stabilized in the stand-by position when the boss 52*a* is not particularly guided. As will be described in detail later in the description of functions, when the feed tray 21 is moved prior to an initial use, the cam 60 formed on the feed tray 21 engages with the boss 52*a* of the action lever 52 provided on the hold block 51, and guides the boss 52*a* along the cam 60. Then, the cam 60 of the feed tray 21 displaces the hold block 51, which holds the pressurization mechanism for the intermediate transfer belt 34 in a pressure release position, to a hold release position for releasing the position holding of the pressurization mechanism (cf. FIG. 5C).

Figure 4A:
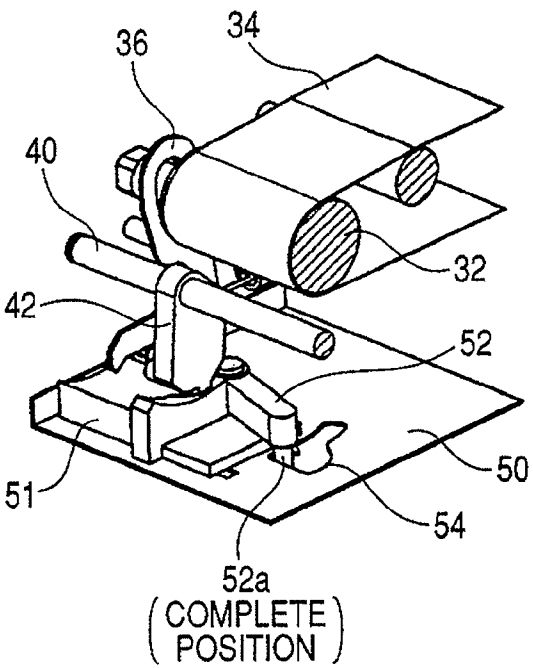
FIGS. 4A, 4B and 4C are views illustrating functions for a tension releasing operation for a belt, in an exemplary embodiment of the present invention.
Figure 4B:
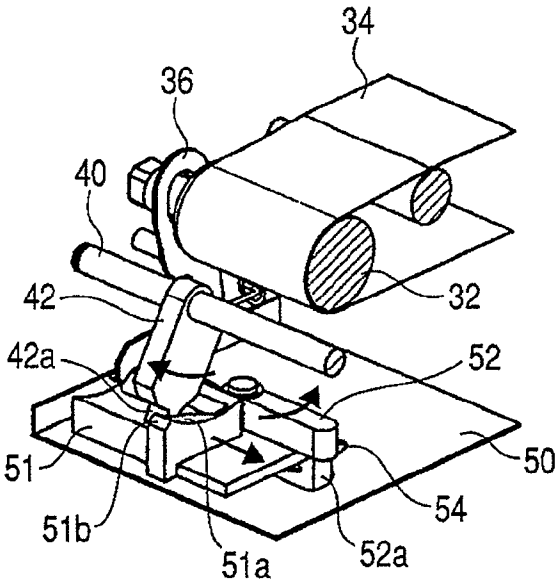
Figure 4C:
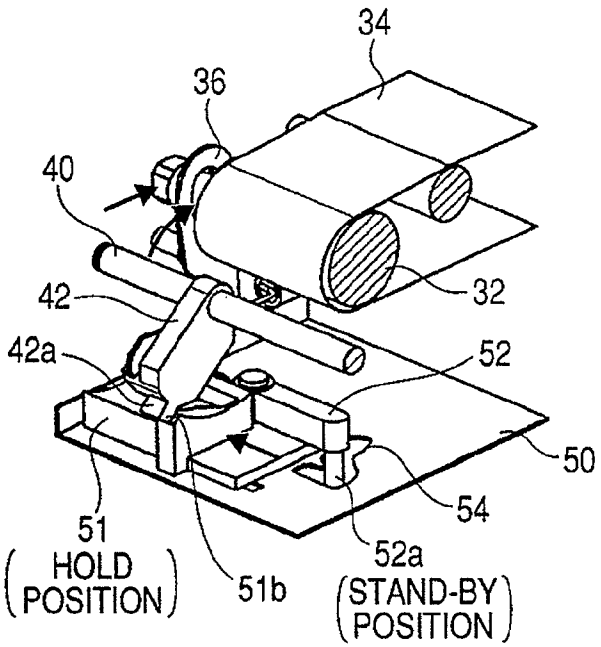

Now functions will be described in the constitution schematically described above. FIGS. 4A to 4C illustrate stages of a tension releasing operation for the intermediate transfer belt at the forwarding of the product. FIGS. 4A to 4C illustrate only the vicinity of the pressure release arm 42, positioned in the rear side of the main body, for the purpose of ease of understanding of the functions.

The tension release of the intermediate transfer belt 34 is executed by rotating the pressure release shaft 40 from the front side of the apparatus by means of a tool (not illustrated). When the pressure release shaft 40 is rotated by the tool, the projection portion 42*a* of the pressure release arm 42 acts on the cam portion 51*a* of the hold block 51, whereby the hold block 51 moves against the urging force of the spring 53 (FIG. 4B). Also the pressure release arm 42 causes a rocking motion of the tension lever 36 of the ITB unit 30 against the pressurizing force of the tension spring 38, thereby releasing the intermediate transfer belt 34 from the tension provided by the tension roller 32. Subsequently, when the rotation or the pressure release shaft 40 reaches a predetermined phase, the engagement between the projection portion 42*a* of the pressure release arm 42 and the cam portion 51*a* of the hold block 51, causing the displacement of the hold block 51, is disengaged, whereby the hold block 51 returns in the urging direction of the spring 53 (FIG. 4C). Even when the tool (not illustrated) that has rotated the pressure release shaft 40 is detached in this state, the pressure release shaft is locked in the rotated state, since the projection portion 42*a* of the pressure release arm 42 engages with a lock portion 51*b* (hold portion) of the hold block 51. Therefore the pressurization mechanism of the intermediate transfer belt 34 is held in a pressure release position (cf. FIG. 4C) in which the pressurization is released, and the intermediate transfer belt 34 is held in a tension released state. The position of the hold block 51 in such state is called a hold position. At a point where the aforementioned operation is completed, the rocking position of the action lever 52 is always in the stand-by position, by the function of the spring 53.

Now there will be described a pressurizing operation (hold release operation of the pressurization mechanism) at the installation of the apparatus. FIGS. 5A to 5D illustrate stages of the hold release of the pressurization mechanism. FIGS. 5A to 5D illustrate only mechanisms around the hold block 51, for the purpose of each of understanding. As regards the stay member 50 of the main body, the guide hole 54 alone is illustrated.

Figure 5B:
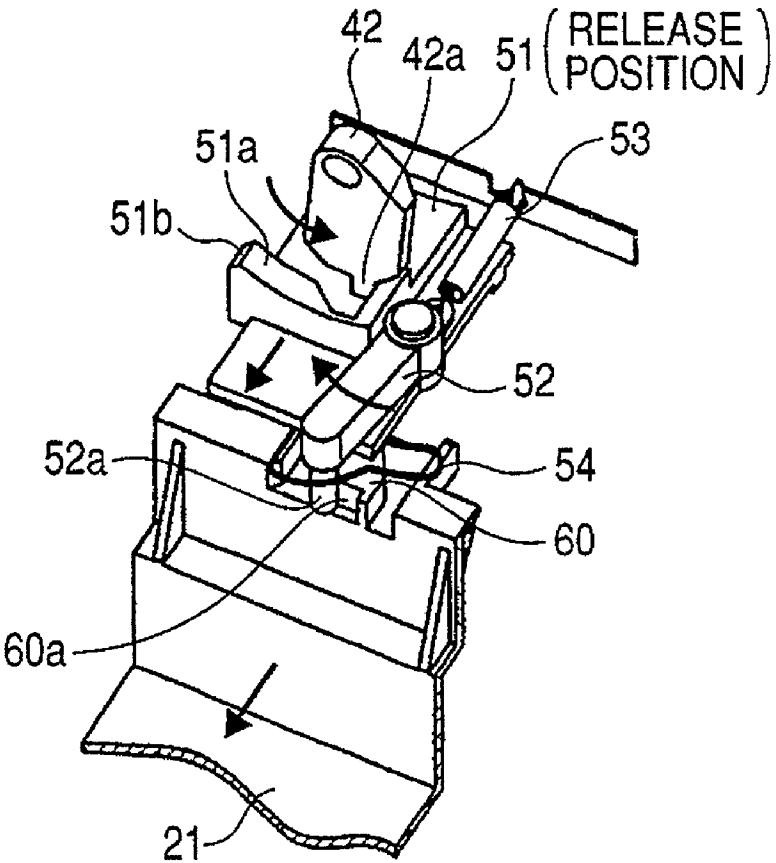
FIGS. 5A, 5B, 5C and 5D are views illustrating operations of pressure release and hold release in the pressurization mechanism of the exemplary embodiment 1 of the present invention.
Figure 5A:
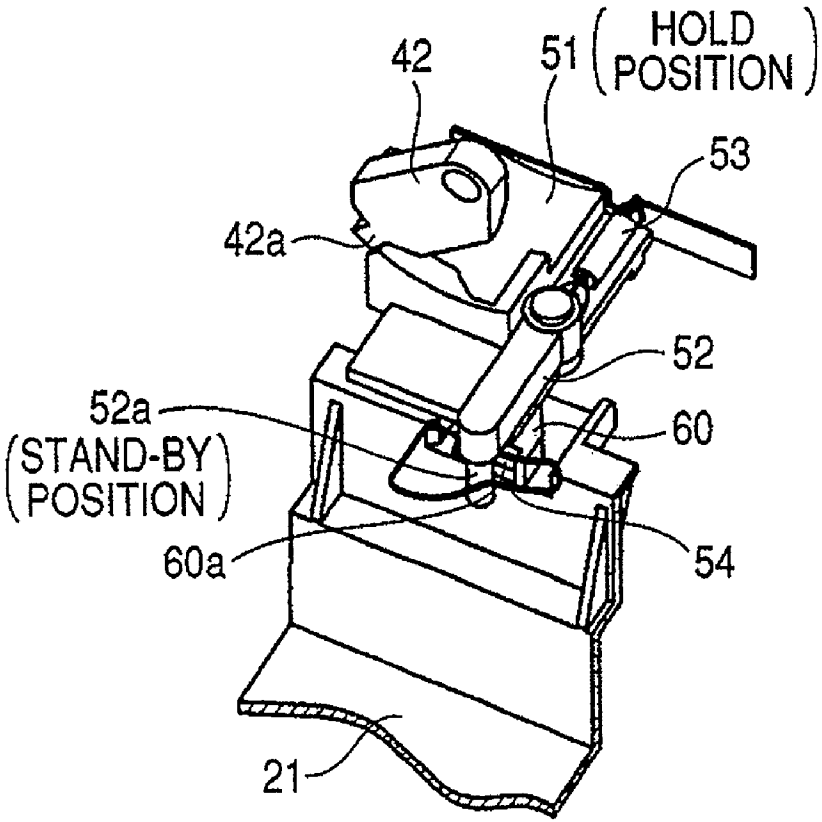
Figure 5D:
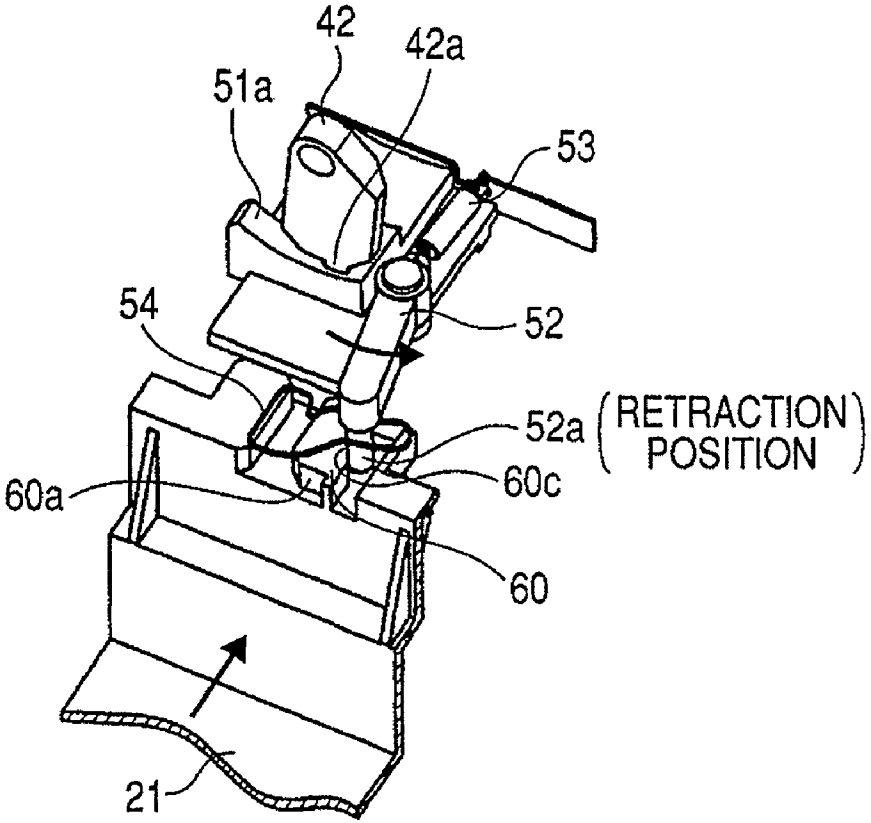
Figure 5C:
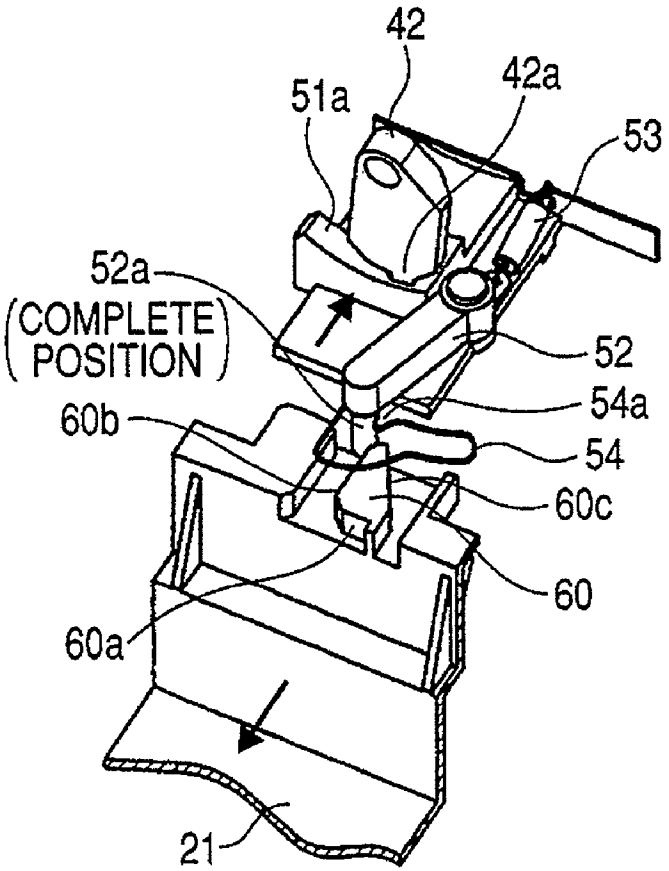

Prior to an image output, the sheet for printing has to be stored in the feed tray 21, and the user executes such storing operation in a period from the installation of the product to the use thereof. When the feed tray 21 is extracted prior to the initial use of the apparatus, an engaging face 60*a*, formed in a part of the cam 60 at the rear side of the feed tray 21, engages with the boss 52*a* of the action lever 52. Then, the hold block 51 linked with the action lever 52 starts to move from the hold position (pressure release position of the pressurization mechanism), in linkage with the moving operation of the feed tray 21 (FIG. 5A). When the displacement of the hold block 51 reaches a predetermined amount, the projection portion 42*a* of the pressure release arm 42 is disengaged from the lock portion 51*b* of the hold block 51 (FIG. 5B). The position of the hold block 51 in this state is called a release position. Thus, the pressure release arm 42 rotates in a direction of arrow in FIG. 5B by the function of the spring 39, whereby the intermediate transfer belt 34 is released from the tension release function by the pressure release arm 42 and is thus pressurized by the pressurization mechanism. When the feed tray 21 is further extracted, the rocking angle of the action lever 52 gradually increases as guided by the guide hole 54 of the stay member 50, and the boss 52*a* is eventually disengaged from the engaging face 60*a* of the cam 60. When the boss 52*a* is disengaged from the cam 60, the hold block 51 moves, by the action of the spring 53, in the biasing direction thereof (FIG. 5C). In this state, the action lever 52 moves with the hold block 51 while maintaining the rocking angle by a limiting face 60*b* of the feed tray 21, and eventually stopped in a completion position (hold release position of the hold block 51) where the boss 52*a* engages with a stand-by claw 54*a* of the guide hole 54. In this manner completed is a hold release operation of moving the hold block 51, holding the pressurization mechanism in the pressure release position, to a hold release position where the position holding of the pressurization mechanism is released.

In a state where the rocking position of the action lever 52 is in the completion position, the cam 60 of the feed tray 21 does not interfere with the boss 52*a* of the hold block 51 in the course of extraction and mounting of the tray 21. Therefore, in an ordinary sheet replenishing operation after the installation is completed, feeling in operating the feed tray 21 will not be deteriorated.

Also the present exemplary embodiment has a structure enabling to mount the feed tray 21 later into the main body of the apparatus, even when the tension release of the intermediate transfer belt 34 is executed while the feed tray 21 is not yet mounted in the main body of the apparatus. When the feed tray 21 is pressed into the main body of the apparatus while the rocking position of the action lever 52 is in the stand-by position, as illustrated in FIG. 5D, an inclined face 60*c*, provided in a part of the cam 60 of the feed tray 21, engages with the boss 52*a* of the action lever 52, whereby the boss 52*a* is pressed by the inclined face 60*c*. Thus, the boss 52*a* of the action lever 52 moves along the guide hole 54 of the stay member 50, whereby the action lever 52 rocks to a retraction position. When the cam 60 of the feed tray 21 passes through, the action lever 52 is released again and returns to the stand-by position by the function of the spring 53. Thereafter, by executing the aforementioned moving operation of the feed tray 21, the pressurization of the intermediate transfer belt 34 (hold release operation of the pressurization mechanism), at the installation of the apparatus, is achieved.

In the exemplary embodiment above, a feed tray (sheet containing member) that can be extracted from and stored in the main body of the apparatus has been described as the movable member, but such constitution is not restrictive, and it may for example be a sheet containing member that is detachably attachable to the main body of the apparatus. Further, the movable member may also be an open/close member such as a cover that can be opened from and closed to the main body of the image forming apparatus.

Exemplary Embodiment 2

Figure 6A:
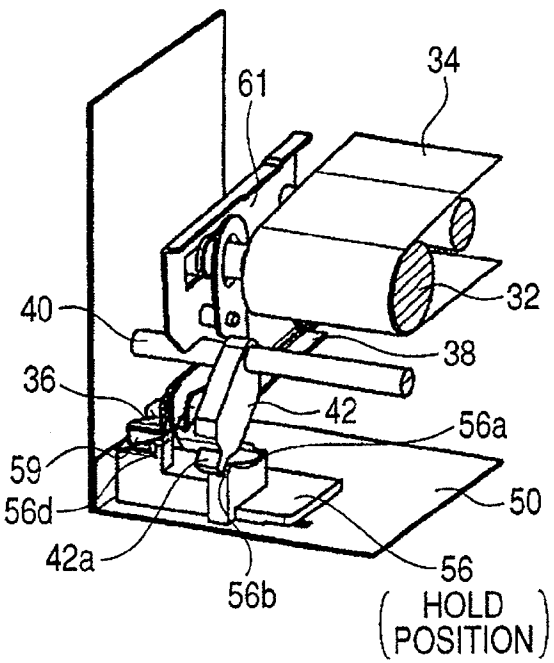
FIGS. 6A, 6B and 6C are views illustrating operations of pressure release and hold release in a pressurization mechanism of an exemplary embodiment 2 of the present invention.
Figure 6B:
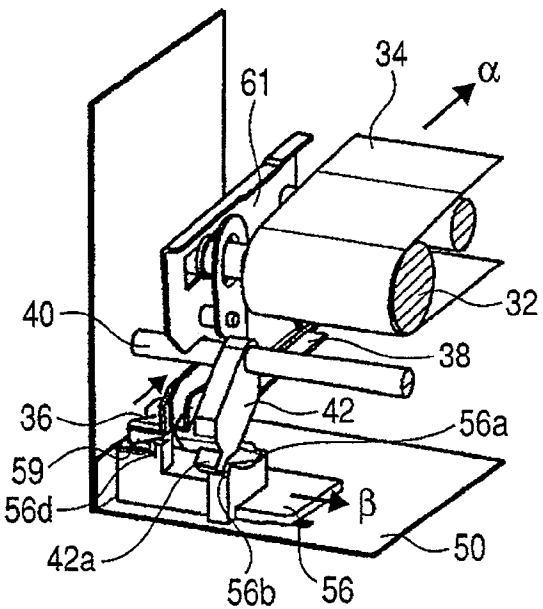
Figure 6C:
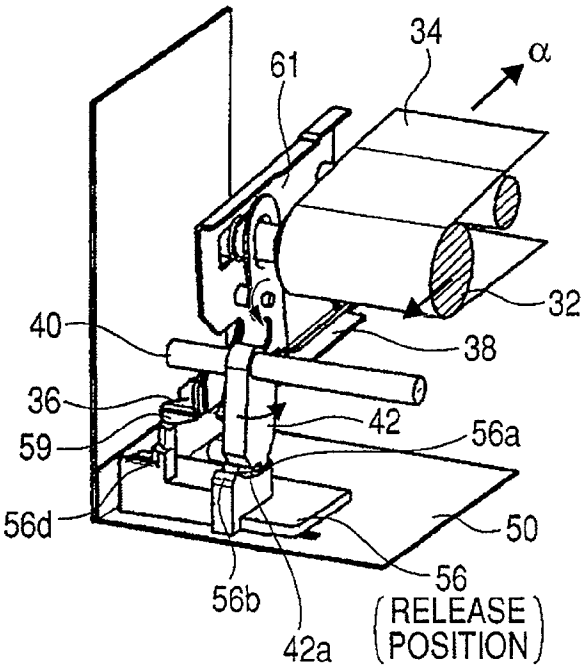

In the present exemplary embodiment, the movable member may be a member belonging to a belt unit (ITB unit 30) which is detachably attached to the main body of the image forming apparatus. A specific example thereof is illustrated in FIGS. 6A to 6C. In the exemplary embodiment illustrated in FIGS. 6A to 6C, an ITB unit 30, including a pressurization mechanism and a belt and detachably attachable to the main body of the image forming apparatus, is attached and detached by the user, and, the hold release operation of the pressurization mechanism is executed automatically, in linkage with such attach/detaching operation.

As in the above-described exemplary embodiment, in a position opposed to the projection portion 42*a* of the pressure release arm 42, a hold block 56 serving as holding means is slidably provided on a stay member 50, constituting a frame of the main body. The hold block 56 has a first cam portion 56*a*, capable of engaging with the projection portion 42*a* of the pressure release arm 42. Also the hold block 56 is given a biasing force by a spring (not illustrated), and is urged toward left in FIGS. 6A to 6C in the movable direction thereof. On the other hand, in the ITB unit 30, provided are an ITB frame 61 supporting an end of a roller which support the belt, and a release hook 59 belonging to the ITB frame 61 and linked therewith. The release hook 59 is in such a positional relationship, capable of engaging with a projection portion 56*d* of the hold block 56 in the attach/detach path of the ITB unit 30. However, in a state illustrated in FIG. 6A, the release hook 59 and the projection portion 56*d* of the hold block 56 are not in mutual contact.

Then described will be a pressurizing operation (hold release operation of the pressurization mechanism). In a pressure released state of the pressurization mechanism of the intermediate transfer belt 34, as illustrated in FIG. 6A, the projection portion 42*a* of the pressure release arm 42 engages with a lock portion (hold portion) 56*b* present in a first cam portion 56*a* of the hold block 56, and the pressure release arm 42 is held in position. In such state, the hold block 56 is in a hold position, corresponding to the pressure release position of the pressurization mechanism of the intermediate transfer belt 34.

Figure 7A:
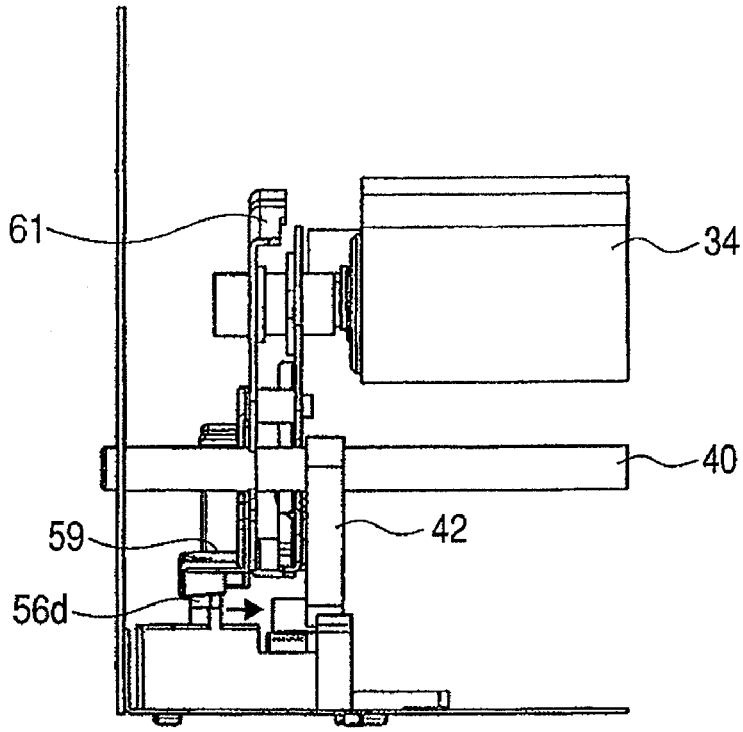
FIGS. 7A and 7B are views illustrating a structure for pressure release and hold release in a pressurization mechanism of an exemplary embodiment 2 of the present invention.
Figure 7B:
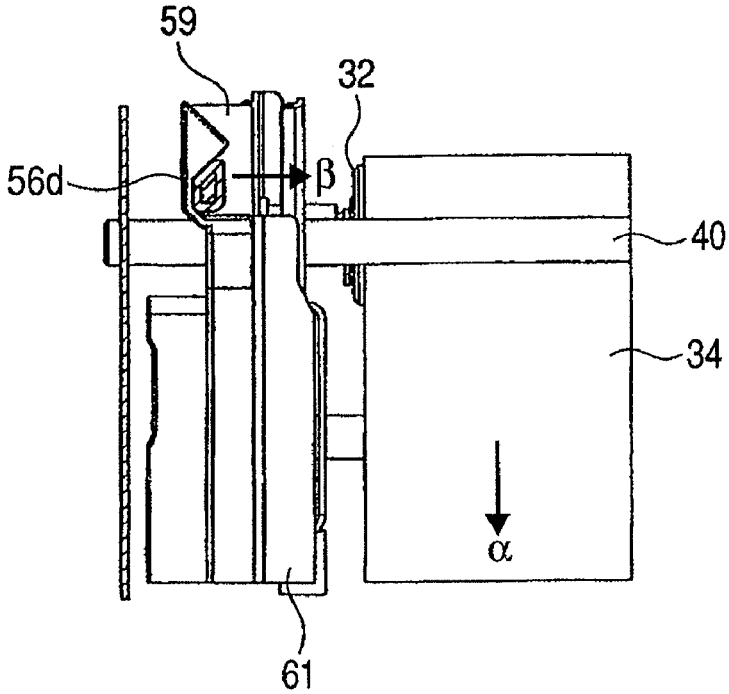

When the ITB unit 30 is extracted in a direction of arrow α, the release hook 59 attached to the ITB unit 30 engages with the projection portion 56*d* of the hold block 56 in the course of such extraction. In this state, the hold block 56 displaces against the biasing force of the spring. The relation of the release hook 59 and the projection portion 56*d* is also illustrated in FIGS. 7A and 7B. FIG. 7A is a cross-sectional view of the structure of FIGS. 6A to 6C, seen from a direction opposite to the arrow α, and FIG. 7B is a view illustrating the state of FIG. 6A, seen from the rear side of the stay member 50. When the ITB unit 30 is extracted in the direction α in FIGS. 6A to 6C, it includes an inclined face contacted by the release hook 56 and the projection portion 56*d*, and the projection portion 56*d* moves in a direction of arrow β along such inclined face. When the hold block 56 moves at least by a predetermined amount, the projection portion 42*a* of the pressure release arm 42 is disengaged from the lock portion 56*b* of the hold block 56. This is because, as described above, the pressure release arm 42 is fixed to the pressure release shaft 40 supported by the frame of the main body, so that the hold block 56 moves relative to the pressure release arm 42. By such disengagement, the pressure release arm 42 is released from the position holding, so that the intermediate transfer belt 34 is pressurized by the function of the tension lever 36 and the tension spring 38 (FIG. 6C). The position of the hold block 56 in this state is a hold release position. After the completion of hold release of the hold block 56, the projection portion 42*a* of the pressure release arm 42 engages with a lateral face of the first cam portion 56*a* of the hold block 56. Therefore, the hold block 56 is retained in the hold release position. In the case that the ITB block is detached and attached after the completion of hold release of the hold block 56, the release hook 59 belonging to the ITB unit 30 and the projection portion 56*d* of the hold block 56 engage with each other, so that the position of the pressure release arm 42 remains unchanged despite of the movement of the hold block 56, whereby the intermediate transfer belt 34 is maintained in the pressurized state.

The present exemplary embodiment includes a portion of a same shape as the hold block 51 in the exemplary embodiment 1, and can therefore be considered a constitution including the projection portion 56*d* added to the hold block 51. Consequently, by replacing the hold block 51 of the exemplary embodiment 1 with the hold block 56 of the present exemplary embodiment, and by additionally providing the release hook 59, an extracting operation of the feed tray 21 or an extracting operation of the ITB unit 30 enables to release the tension release operation for the intermediate transfer belt 34, whereby the intermediate transfer belt 34 is pressurized by the pressurization mechanism.

Exemplary Embodiment 3

Figure 8A:
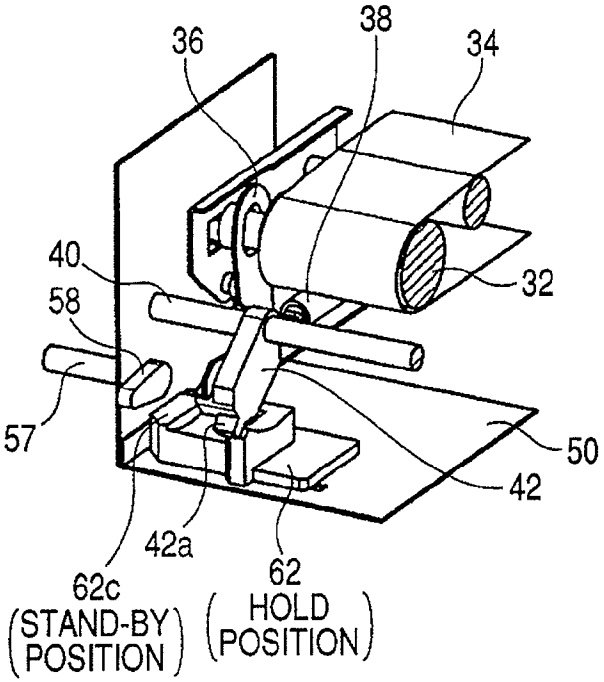
FIGS. 8A, 8B and 8C are views illustrating operations of pressure release and hold release in a pressurization mechanism of an exemplary embodiment 3 of the present invention.
Figure 8B:
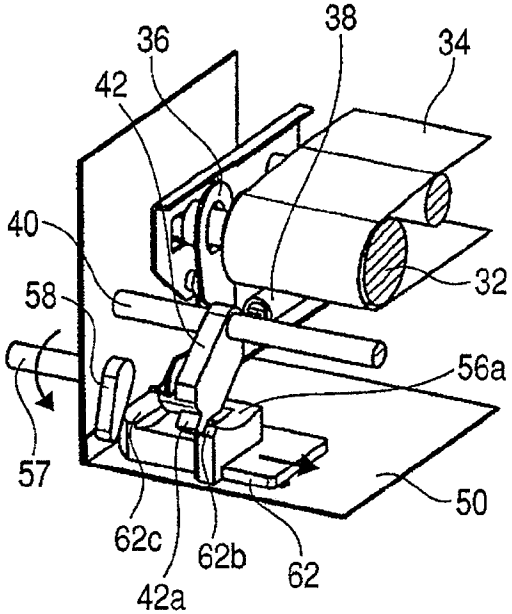
Figure 8C:
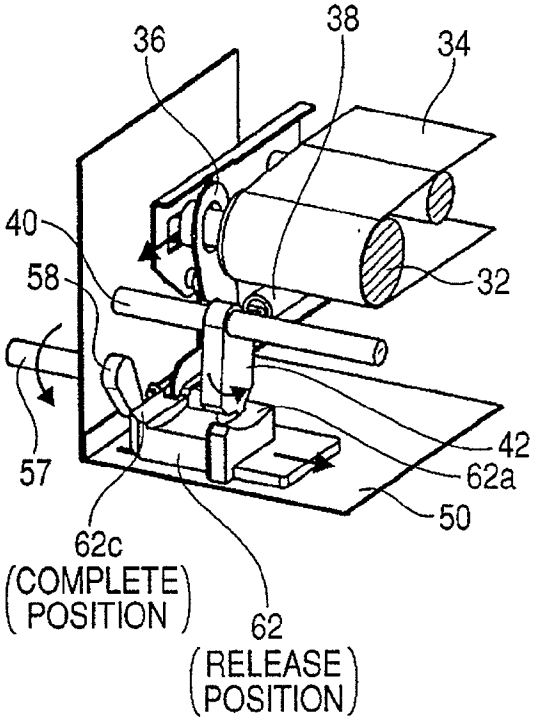

In the present exemplary embodiment, the aforementioned movable member is a link member, which is linked with a drive source in the image forming apparatus. A specific example thereof is illustrated in FIGS. 8A to 8C. In the exemplary embodiment illustrated in FIGS. 8A to 8C, the hold release operation for the pressurization mechanism is executed not by a user operation, but automatically by a drive in the image forming apparatus after the power supply therein is started.

As in the above-described exemplary embodiment, in a position opposed to the projection portion 42*a* of the pressure release arm 42, a hold block 62 serving as holding means is slidably provided on a stay member 50, constituting a frame of the main body. The hold block 62 has a first cam portion

62*a*, capable of engaging with the projection portion 42*a* of the pressure release arm 42. The hold block 62 is provided, at an end portion thereof, with a second cam portion (action part) 62*c* capable of engaging with the link member. Also the hold block 62 is given a biasing force by a spring (not illustrated), and is urged toward left in FIGS. 8A to 8C, in the movable direction thereof. In the vicinity of the second cam portion 62*c*, provided is a release shaft 57, serving as a link member which is rotatable by a drive source in the image forming apparatus, and the release shaft supports a release lever 58 as an engaging portion. The release lever 58 is driven by at least one turn, after the power supply in the image forming apparatus is turned on and before an image forming operation is executed.

Then described is a pressurization operation (hold release operation for the pressurization mechanism) at the installation of the apparatus. In a pressure released state of the pressurization mechanism of the intermediate transfer belt, as illustrated in FIG. 8A, the projection portion 42*a* of the pressure release arm 42 engages with the lock portion (hold portion) 62*b* in the first cam portion 62*a* of the hold block 62, whereby the pressure release arm 42 is maintained in its position. In this state, the hold block 62 is in a hold position, corresponding to the pressure release position of the pressurization mechanism of the intermediate transfer belt 34. Also the position of the second cam portion 62*c* in this state corresponds to the stand-by position of the boss 52*a* in the aforementioned exemplary embodiment. When the release lever 58 starts to rotate after the power supply is turned on, the release lever 58 subsequently acts on the second cam portion 62*c* of the hold block 62, thereby displacing the hold block 62 against the biasing force of the spring (FIG. 8B). When the hold block 62 is displaced at least by a predetermined amount, the projection portion 42*a* of the pressure release arm 42 is disengaged from the lock portion 62*b* of the hold block 62. By such disengagement, the pressure release arm 42 is released from the position holding, whereby the intermediate transfer belt 34 is pressurized by the function of the tension lever 36 and the tension spring 38 (FIG. 8C). In this state, the hold block 62 is in a hold release position. After the completion of hold release of the hold block 62, the projection portion 42*a* of the pressure release arm 42 engages with a lateral face of the first cam portion 62*a* of the hold block 62. Therefore, the hold block 62 is retained in the hold release position. In a state where the hold block 62 is in the hold release position, the second cam 62*c* of the hold block 62 and the release lever 58 are in a non-contacting positional relationship. Therefore, even when the release lever 58 is rotated after the completion of hold release of the hold block 62, the hold block 62 does not become a burden to the rotation of the drive source. The position of the second cam 62*c* in this state corresponds to the completion position of the boss 52*a* in the foregoing exemplary embodiment.

Exemplary Embodiment 4

Figure 9B:
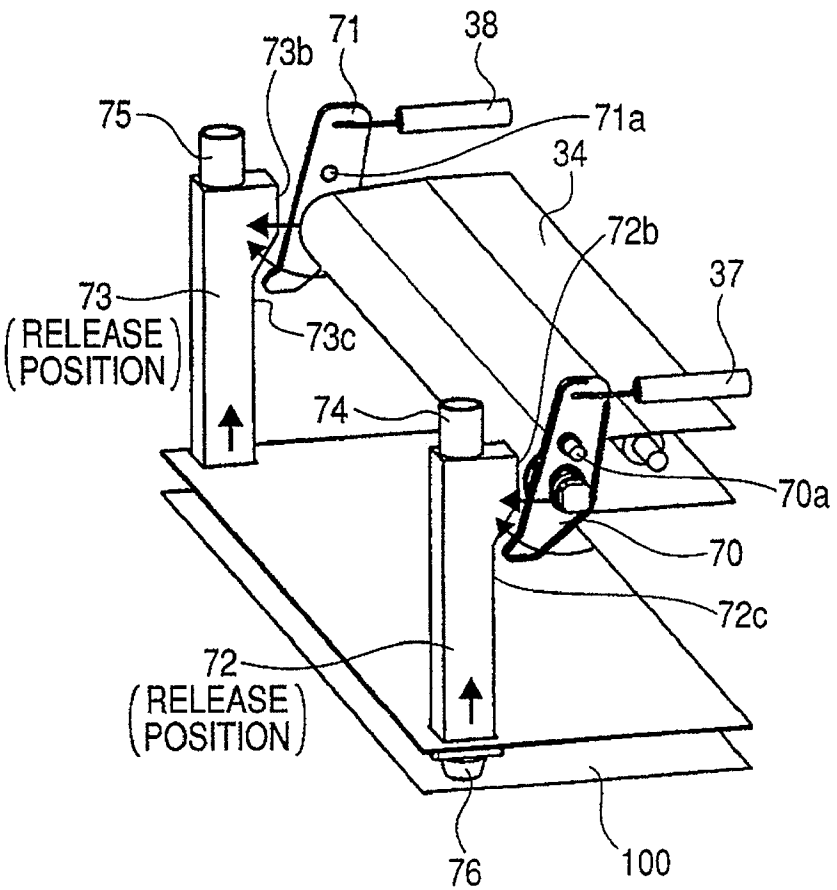
FIGS. 9A and 9B are views illustrating operations of pressure release and hold release in a pressurization mechanism of an exemplary embodiment 4 of the present invention.

An exemplary embodiment of the present invention will be described with reference to FIGS. 9A and 9B. The basic structure of the image forming apparatus will not be described as it is similar to that in the exemplary embodiments above. Also as the object of pressure release, a pressurization mechanism for an intermediate transfer belt will be taken as an example as in the exemplary embodiment 1, and components equivalent in functions to those therein will be represented by like reference numerals.

At first, the schematic constitution of the apparatus will be described. FIGS. 9A and 9B illustrate the schematic structure and operation states in the position hold releasing mechanism for the pressurization mechanism of the present exemplary embodiment.

At first, a pressurization mechanism for the intermediate transfer belt 34 and movable members will be described. Tension levers 70, 71 are supported, by an unillustrated unit frame, so as to be capable of a rocking motion about rotary shafts 70*a*, 71*a*. The intermediate transfer belt 34 is given a tension, by a tension roller 32 constituting a pressurization mechanism and by the tension levers 70, 71 and tension springs 37, 38. In the present exemplary embodiment, the main body of the image forming apparatus is to be supported on the floor by four legs, of which two illustrated legs 76, 77 are formed as telescoping movable legs. The movable legs 76, 77 are fixed on hold rods 72, 73 constructed as movable members that can slide in the vertical direction of the apparatus, and are urged downwards by compression springs 74, 75.

Then described is the constitution of the position hold releasing mechanism for the pressurization mechanism. Tension levers 70, 71 have projection portions 70*b*, 71*b* capable of engaging with hold rods 72, 73 fixed to the movable legs 76, 77. The hold rods 72, 73 integrally have release cams 72*a*, 73*a* constituting hold portions which engage with the projection portions 70*b*, 71*b* of the tension levers 70, 71 thereby holding the pressurization mechanism in a pressure release position. In a state where the movable legs 76, 77 protrude downwards to the lower side of the main body of the apparatus, convex portions 72*b*, 73*b* of the release cams 72*a*, 73*a* press the projection portions 70*b*, 71*b* of the tension levers 70, 71 thereby rocking the tension levers 70, 71 to the pressure releasing direction. The tension levers 70, 71, that have rocked to the pressure releasing direction, are held in a pressure release position (cf. FIG. 9A) by release cams 72*a*, 73*a* of the hold rods 72, 73. On the other hand, in a state where the movable legs 76, 77 are retracted into the main body of the apparatus, the projection portions 70*b*, 71*b* of the tension levers 70, 71 are opposed to recessed portions 72*c*, 73*c* of the release cams 72*a*, 73*a*, whereby these members are not in mutual contact and the position of the tension levers 70, 71 is not restricted. In this manner, by the movement of the hold rods 72, 73, the release cams 72*a*, 73*a*, which hold the pressurization mechanism in the pressure release position, move to a hold release position (cf. FIG. 9B) where the position holding of the pressurization mechanism is released.

Figure 9A:
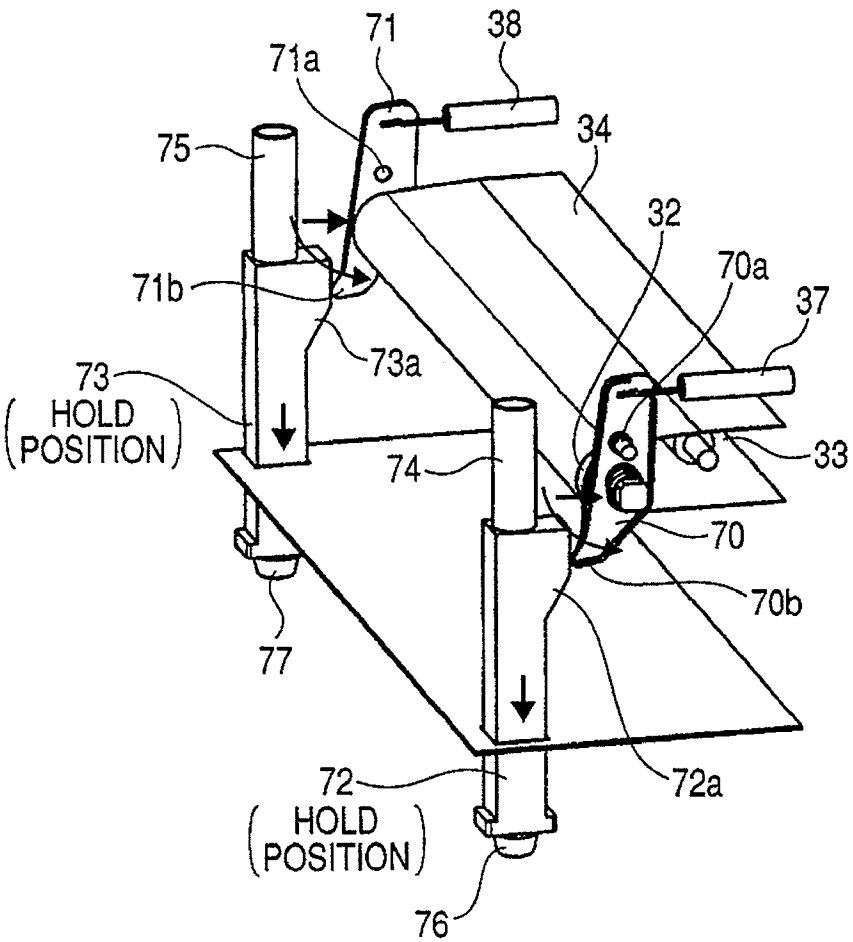
Figure 10A:
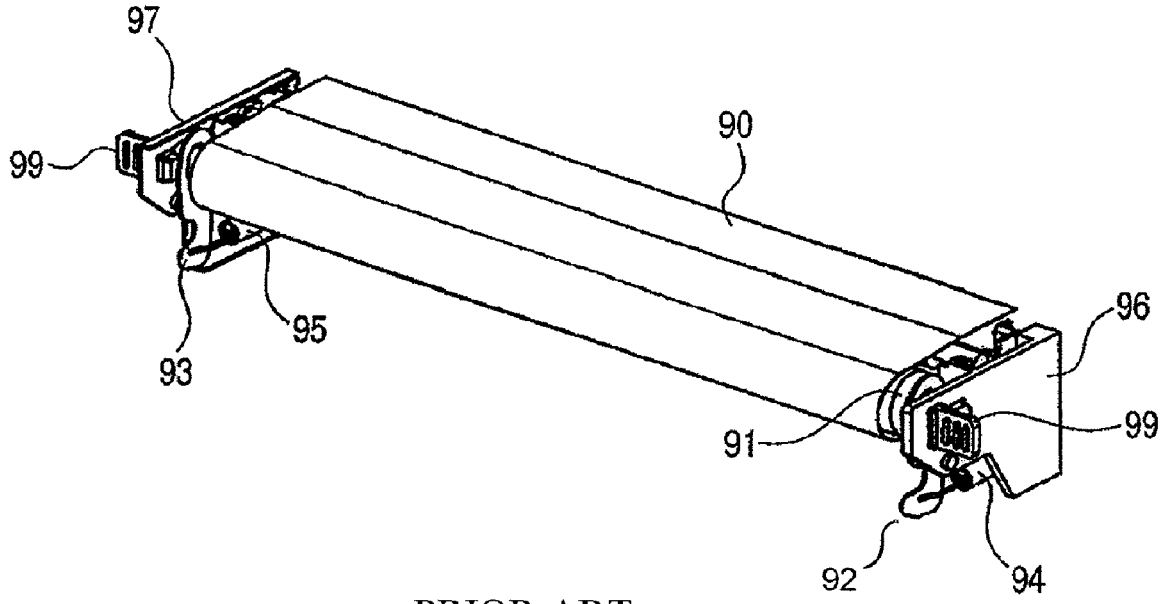
FIGS. 10A and 10B are schematic perspective views illustrating pressure release and hold release in a background art.
Figure 10B:
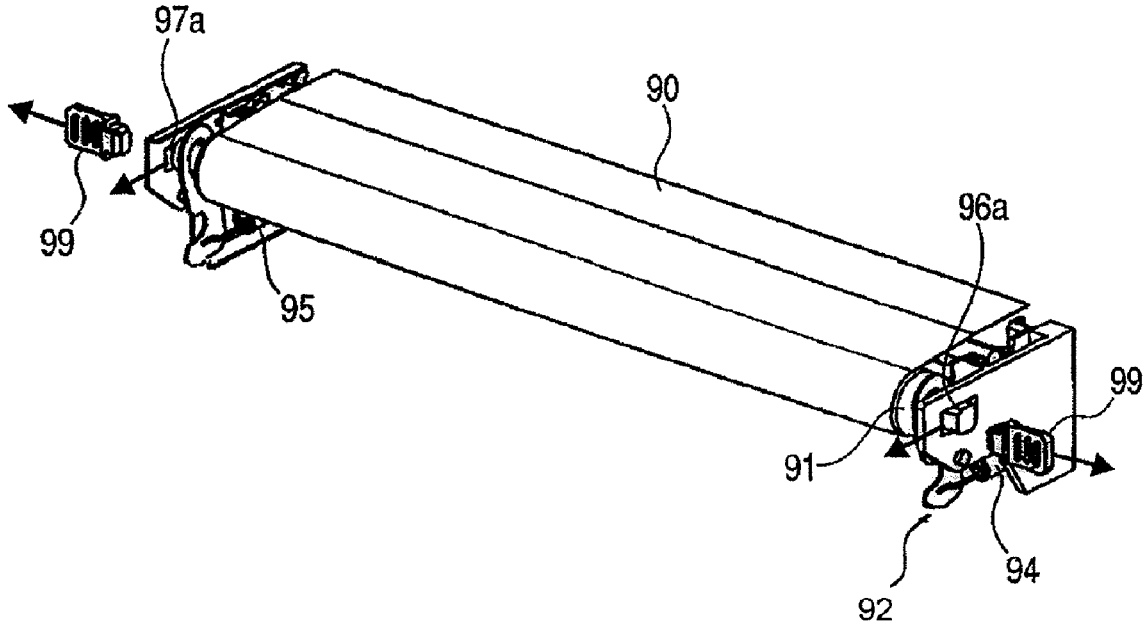
PRIOR ART FIG. 10B

At the delivery of the product, it is so packaged that the movable legs 76, 77 do not receive a regulation by a floor 100 as illustrated in FIG. 9A. Therefore, the movable legs 76, 77 are in a state stretched downwards to the lower side of the apparatus. Therefore, the projection portions 70*b*, 71*b* of the tension levers 70, 71 engage with the convex portions 72*b*, 73*b* of the release cams 72*a*, 73*a*. Thus, by the function of the release cams 72*a*, 73*a* of the hold rods 72, 73, the tension levers 70, 71 are supported in a state where the tension roller 32 is moved in the pressure release direction, whereby the pressurization mechanism for the intermediate transfer belt 34 is released from the tension. When the product is unpacked and placed on the floor 100, the movable legs 76, 77 are pressed by the floor 100 and retracted as illustrated in FIG. 9B. Thus the release cams 72*a*, 73*a* of the hold rods 72, 73 slide in linkage in the same direction, thereby releasing the engagement with the projection portions 70*b*, 71*b* of the tension levers 70, 71. In this manner the tension levers 70, 71 and the tension roller 32 are released from the position holding, whereby the intermediate transfer belt 34 is given a tension by the pressurization mechanism.

In the case that the compression springs 74, 75 have a sufficient pressure, the tension of the intermediate transfer belt 34 is automatically released by the function of the compression springs 74, 75 when the product is lifted from the floor 100 for example at the forwarding of the product. Therefore, no particular pressure releasing operation is necessary. On the other hand, in the case that the spring force is insufficient, the pressure release operation may be executed for example with an exclusive tool, as in the exemplary embodiment 1. The methods of pressure release are not restricted to those described in the foregoing.

In the exemplary embodiments described above, an intermediate transfer belt for supporting a primary image formed by the toner has been described as an example of the pressurized member to be pressurized by the pressurization mechanism, but the present invention is not limited to such case. It may also be another belt in the form of an endless belt supported by plural rollers and given a tension by a pressurization mechanism, such as a suction belt for conveying a sheet under suction. Also the pressurization mechanism is not restricted to a pressurization mechanism for providing an endless belt with a tension, but may also be, for example, a pressurization mechanism which pressurizes, in a pair of rollers for conveying a sheet, one of the rollers to the other. The present invention may be applied to an image forming apparatus including such pressurization mechanism, to obtain similar effects.

Also the aforementioned exemplary embodiments employ four image forming units, but the number of the image forming units is not limited thereto and may be selected suitably.

Also the foregoing exemplary embodiments have described a printer as the image forming apparatus, but the present invention is not limited to such case and is applicable to other image forming apparatuses such as a copying apparatus or a facsimile, or a composite apparatus in which these functions are combined. The present invention may be applied to such image forming apparatus to obtain similar effects.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2006-080876, filed Mar. 23, 2006 and No. 2007-062796, Mar. 13, 2007, which are hereby incorporated by reference in their entirety.

What is claimed is:

1. An image forming apparatus comprising:

a unit that can be positioned at a first position and a second position with respect to a main body of the apparatus;

a belt which is arranged to be placed in a pressurized state or a pressure-released state;

a support member in contact with an internal surface of said belt;

a tension member which moves said support member, which movement puts said belt in the pressurized state; and a restriction member for restricting a movement of said support member, wherein said unit is stored in the main body in the first position and is extracted from the main body in the second position; and said support member is released from the restriction of said restriction member and subject to movement by said tension member when said unit is moved from the first position to the second position, and said support member is maintained on release from the restriction of said restriction member even if said unit is moved from the second position to the first position.

2. An image forming apparatus according to claim 1, wherein an image is able to be formed after said unit is returned from the second position to the first position once.

3. An image forming apparatus according to claim 1, wherein said belt is slack, when said restriction member restricts the movement of said support member.

4. An image forming apparatus according to claim 1, wherein said unit is a cassette for containing a recording material.

5. An image forming apparatus according to claim 1, further comprising:

an image bearing member for bearing a toner image;

wherein said belt contributes in transferring the toner image from said image bearing member, onto a recording material.

* * * * *